US009212808B2

(12) United States Patent
Higley et al.

(10) Patent No.: US 9,212,808 B2
(45) **Date of Patent: *Dec. 15, 2015**

(54) LED LIGHTING FIXTURE

(75) Inventors: Robert Higley, Durham, NC (US); Yuming Chen, Cary, NC (US); Carleton Coleman, Durham, NC (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/911,204

(22) Filed: Oct. 25, 2010

(65) Prior Publication Data

US 2011/0069488 A1 Mar. 24, 2011

Related U.S. Application Data

(63) Continuation of application No. 11/689,614, filed on Mar. 22, 2007, now Pat. No. 7,824,070.

(51) Int. Cl.
*F21V 21/00* (2006.01)
*F21V 23/02* (2006.01)
(Continued)

(52) U.S. Cl.
CPC ..... *F21V 23/026* (2013.01); *F21V 15/01* (2013.01); *F21V 23/008* (2013.01); *F21V 29/74* (2015.01);
(Continued)

(58) Field of Classification Search
CPC ..... F21Y 2101/02; F21Y 2105/00; F21Y 2105/001; F21Y 2103/003; F21Y 2113/005; F21K 9/00; F21S 8/04; F21S 8/00; F21S 8/06; F21S 48/115; F21S 8/026; F21S 8/046; F21S 2/005; F21V 21/00; F21V 21/02; F21V 23/007; F21V 29/004; F21V 23/026; F21V 29/74; F21V 23/008; F21V 15/01; A61B 1/0684; G01N 2021/6463; G09F 13/0413; A42B 1/244; E04H 3/30; H01L 33/486; H01L 33/62; H01L 33/642; F21W 2131/10; Y10S 362/80
USPC ..... 362/221, 224, 225, 227, 84, 184, 362/217.01, 218, 249.02, 311.02, 345, 800, 362/362, 612, 555, 294, 373, 249, 545, 362/547; 313/1; 345/48, 82, 44, 55
See application file for complete search history.

(56) References Cited

U.S. PATENT DOCUMENTS 2,295,339 A * 9/1942 Ericson ..... 362/267
2,907,870 A * 10/1959 Calmes ..... 362/294
(Continued)

FOREIGN PATENT DOCUMENTS

EP 1081771 3/2001
EP 1111966 6/2001
(Continued)

OTHER PUBLICATIONS

Narendran et al., "Solid-state lighting: failure analysis of white LEDs", *Journal of Crystal Growth*, vol. 268, Issues 1-4, Aug. 2004, Abstract.
(Continued)

*Primary Examiner* — Stephen F Husar
*Assistant Examiner* — Danielle Allen
(74) *Attorney, Agent, or Firm* — Jenkins, Wilson, Taylor & Hunt, P.A.

(57) ABSTRACT

A light-emitting diode (LED) lighting fixture is provided as a potential solid state lighting (SSL) replacement fixture for a conventional HID lamp fixture. The LED lighting fixture includes a main housing having a bottom surface supporting an array of LEDs, a top surface and sides, and at least one driver provided in a side housing attached to a side of the main housing to drive the LED array. The thickness of the side housing is equal to or greater than the thickness of the main housing. A plurality of heat spreading fins is arranged on the top surface of the main housing.

25 Claims, 5 Drawing Sheets

(51) Int. Cl.

| | |
|---|---|
| ***F21V 15/01*** | (2006.01) |
| ***F21V 23/00*** | (2015.01) |
| ***F21V 29/74*** | (2015.01) |
| *F21V 29/00* | (2015.01) |
| *F21Y 101/02* | (2006.01) |
| *F21S 2/00* | (2006.01) |
| *F21Y 103/00* | (2006.01) |
| *F21Y 113/00* | (2006.01) |

(52) U.S. Cl.

CPC ..... *F21S 2/005* (2013.01); *F21V 29/004* (2013.01); *F21Y 2101/02* (2013.01); *F21Y 2103/003* (2013.01); *F21Y 2113/005* (2013.01); *Y10S 362/80* (2013.01)

(56) References Cited

U.S. PATENT DOCUMENTS

| | | | | |
|---|---|---|---|---|
| 3,805,937 | A | 4/1974 | Hatanaka et al. | |
| 3,927,290 | A | 12/1975 | Denley | |
| 4,325,146 | A | 4/1982 | Lennington | |
| 4,408,157 | A | 10/1983 | Beaubien | |
| 4,420,398 | A | 12/1983 | Castino | |
| 5,087,883 | A | 2/1992 | Hoffman | |
| 5,101,326 | A | 3/1992 | Roney | |
| 5,111,606 | A * | 5/1992 | Reynolds | 40/661.02 |
| 5,264,997 | A | 11/1993 | Hutchisson et al. | |
| 5,407,799 | A | 4/1995 | Studier | |
| 5,410,519 | A | 4/1995 | Hall et al. | |
| 5,563,849 | A | 10/1996 | Hall et al. | |
| 5,890,784 | A * | 4/1999 | Domig | 312/334.4 |
| 5,890,794 | A * | 4/1999 | Abtahi et al. | 362/294 |
| 6,076,936 | A | 6/2000 | George | |
| 6,082,870 | A | 7/2000 | George | |
| 6,095,666 | A | 8/2000 | Salam | |
| 6,221,095 | B1 | 4/2001 | Van Zuylen et al. | |
| 6,252,254 | B1 | 6/2001 | Soules et al. | |
| 6,292,901 | B1 | 9/2001 | Lys et al. | |
| 6,335,538 | B1 | 1/2002 | Prutchi et al. | |
| 6,348,766 | B1 | 2/2002 | Ohishi et al. | |
| 6,357,889 | B1 | 3/2002 | Duggal et al. | |
| 6,394,621 | B1 | 5/2002 | Hanewinkel | |
| 6,416,200 | B1 | 7/2002 | George | |
| 6,429,583 | B1 | 8/2002 | Levinson et al. | |
| 6,450,668 | B1 | 9/2002 | Kotloff | |
| 6,522,065 | B1 | 2/2003 | Srivastava et al. | |
| 6,590,220 | B1 * | 7/2003 | Kalley et al. | 250/504 H |
| 6,598,994 | B1 | 7/2003 | Tait et al. | |
| 6,624,350 | B2 | 9/2003 | Nixon et al. | |
| 6,791,257 | B1 | 9/2004 | Sato et al. | |
| 6,874,911 | B2 | 4/2005 | Yoneda | |
| 6,880,954 | B2 | 4/2005 | Ollett et al. | |
| 7,086,756 | B2 | 8/2006 | Maxik | |
| 7,093,958 | B2 | 8/2006 | Coushaine | |
| 7,210,818 | B2 | 5/2007 | Luk et al. | |
| 7,213,940 | B1 | 5/2007 | Van De Ven et al. | |
| 7,350,955 | B2 | 4/2008 | Chang et al. | |
| 7,614,759 | B2 | 11/2009 | Negley | |
| 7,625,103 | B2 | 12/2009 | Villard | |
| 7,648,257 | B2 | 1/2010 | Villard | |
| 7,665,862 | B2 | 2/2010 | Villard | |
| 7,718,991 | B2 | 5/2010 | Negley | |
| 7,722,220 | B2 | 5/2010 | Van De Ven | |
| 7,737,459 | B2 | 6/2010 | Edmond | |
| 7,744,243 | B2 | 6/2010 | Van De Ven | |
| 7,766,508 | B2 | 8/2010 | Villard et al. | |
| 7,768,192 | B2 | 8/2010 | Van De Ven | |
| 7,777,166 | B2 | 8/2010 | Roberts | |
| 7,824,070 | B2 | 11/2010 | Higley et al. | |
| 8,118,450 | B2 | 2/2012 | Villard | |
| 8,408,739 | B2 | 4/2013 | Villard et al. | |
| 8,646,944 | B2 | 2/2014 | Villard | |
| 2002/0006350 | A1 | 1/2002 | Nishida et al. | |
| 2002/0087532 | A1 | 7/2002 | Barritz et al. | |
| 2003/0057430 | A1 | 3/2003 | Rinaldi et al. | |
| 2003/0117798 | A1 | 6/2003 | Leysath | |
| 2004/0090794 | A1 | 5/2004 | Ollett et al. | |
| 2004/0165379 | A1 * | 8/2004 | Waters | 362/231 |
| 2004/0212998 | A1 | 10/2004 | Mohacsi | |
| 2004/0252962 | A1 | 12/2004 | Ryan, Jr. | |
| 2005/0099478 | A1 | 5/2005 | Iwase | |
| 2005/0231948 | A1 | 10/2005 | Pohlert et al. | |
| 2005/0237739 | A1 | 10/2005 | Lee et al. | |
| 2005/0274972 | A1 | 12/2005 | Roth et al. | |
| 2005/0278998 | A1 | 12/2005 | Sawhney et al. | |
| 2006/0120073 | A1 | 6/2006 | Pickard et al. | |
| 2006/0138937 | A1 | 6/2006 | Ibbetson | |
| 2006/0248761 | A1 * | 11/2006 | Cheung et al. | 40/564 |
| 2007/0137074 | A1 | 6/2007 | Van De Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0223219 | A1 | 9/2007 | Medendorp et al. | |
| 2007/0267983 | A1 | 11/2007 | Van De Ven | |
| 2007/0268707 | A1 | 11/2007 | Smester | |
| 2007/0274080 | A1 | 11/2007 | Negley | |
| 2007/0278503 | A1 | 12/2007 | Van De Ven | |
| 2007/0278934 | A1 | 12/2007 | Van De Ven | |
| 2007/0278974 | A1 | 12/2007 | Van De Ven | |
| 2007/0279440 | A1 | 12/2007 | Negley | |
| 2007/0280624 | A1 | 12/2007 | Negley | |
| 2008/0002399 | A1 * | 1/2008 | Villard et al. | 362/184 |
| 2008/0084685 | A1 | 4/2008 | Van De Ven | |
| 2008/0084700 | A1 | 4/2008 | Van De Ven | |
| 2008/0084701 | A1 | 4/2008 | Van De Ven | |
| 2008/0089053 | A1 | 4/2008 | Negley | |
| 2008/0106895 | A1 | 5/2008 | Van De Ven | |
| 2008/0130265 | A1 | 6/2008 | Negley | |
| 2008/0130285 | A1 | 6/2008 | Negley | |
| 2008/0136313 | A1 | 6/2008 | Van De Ven | |
| 2008/0170396 | A1 | 7/2008 | Yuan | |
| 2008/0192493 | A1 | 8/2008 | Villard | |
| 2008/0231201 | A1 | 9/2008 | Higley | |
| 2008/0259589 | A1 | 10/2008 | Van De Ven | |
| 2008/0278928 | A1 | 11/2008 | Van De Ven | |
| 2008/0278940 | A1 | 11/2008 | Van De Ven | |
| 2008/0304260 | A1 | 12/2008 | Van De Ven | |
| 2008/0304261 | A1 | 12/2008 | Van De Ven | |
| 2009/0002986 | A1 | 1/2009 | Medendorp | |
| 2009/0161356 | A1 | 6/2009 | Negley | |
| 2009/0184616 | A1 | 7/2009 | Van De Ven | |
| 2009/0246895 | A1 | 10/2009 | You | |
| 2009/0323334 | A1 | 12/2009 | Roberts | |
| 2010/0214780 | A1 | 8/2010 | Villard | |
| 2010/0296289 | A1 | 11/2010 | Villard et al. | |
| 2012/0188757 | A1 | 7/2012 | Villard | |
| 2014/0140052 | A1 | 5/2014 | Villard | |

FOREIGN PATENT DOCUMENTS

| | | |
|---|---|---|
| WO | WO98/43014 | 10/1998 |
| WO | WO00/34709 | 6/2000 |

OTHER PUBLICATIONS

Van de Ven et al., "Warm White Illumination with High CRI and High Efficacy by Combining 455 nm Excited Yellowish Phosphor LEDs and Red A1InGaP LEDs", *First Internat'l Conf. on White LEDs and Solid State Lighting*, Nov. 30, 2007.

Shimizu, "Development of High-Efficiency LED Downlight", *First Internat'l Conf. on White LEDs and Solid State Lighting*, Nov. 30, 2007.

PermLight.com product advertisement sheet dated at least as early as 2005.

Press Release from LED Lighting Fixtures dated Jan. 26, 2006 entitled "LED Lighting Fixtures Creates 750 Lumen Recessed Light and Uses Only 16 Watts of Power".

Press Release from Led Lighting Fixtures dated Feb. 16, 2006 entitled "LED Lighting Fixtures, Inc. Announces Record Performance".

Press Release from LED Lighting Fixtures dated Apr. 24, 2006 entitled "LED Lighting Fixtures, Inc. achieves unprecedented gain in light output from new luminaire".

(56) References Cited

OTHER PUBLICATIONS

Press Release from LED Lighting Fixtures dated May 30, 2006 entitled "LED Lighting Fixtures, Inc. Sets World Record at 80 Lumens per Watt for Warm White Fixture".
Press Release from LED Lighting Fixtures dated Feb. 7, 2007 entitled "LED Lighting Fixtures Announces its first LED-based Recessed Down Light".
Press Release from LED Lighting Fixtures dated May 4, 2007 entitled "LED Lighting Fixtures to Expand Product Line".
Press Release from LED Lighting Fixtures dated Nov. 28, 2007 entitled "New Lamp from LED Lighting Fixtures Shatters World Record for Energy Efficiency".
CSA International, "Test Data Report," Project No. 1786317, Report No. 1786317-1 (Apr. 2006).
Compound Semiconductors Online, "LED Lighting Fixtures, Inc. Sets World Record at 80 Lumens per Watt for Warm White", dated May 30, 2006, http://www.compound.semi.com/documents/articles/cldoc?6802.html.
DOE SSL CALiPer Report, "Product Test Reference: CALiPER 07-31 Downlight Lamp", Date of testing Sep. 7 to Sep. 10, 2007.
DOE SSL CALiPer Report, "Product Test Reference: CALiPER 07-47 Downlight Lamp", Date of testing Sep. 7 to Sep. 10, 2007.
U.S. Department of Energy, "DOE Solid-State Lighting CALiPER Program, Summary of Results: Round 3 of Product Testing," Oct. 2007.
U.S. Department of Energy, "DOE Solid-State Lighting CALiPER Program, Summary of Results: Round 4 of Product Testing," Jan. 2008.
U.S. Department of Energy, "DOE Solid-State Lighting CALiPER Program, Summary of Results: Round 5 of Product Testing," May 2008.
OptoLED Lighting GmbH product sheets—at least as early as Apr. 2008.
International Search Report and Written Opinion for PCT/US06/48521 dated Feb. 7, 2008.
International Search Report and Written Opinion for PCT/US07/12706 dated Jul. 3, 2008.
Non-Final Office Action for U.S. Appl. No. 11/519,058 dated Aug. 14, 2008.
European Search Report for EP Appl. No. 06845870.2 dated Nov. 6, 2008.
Final Office Action for U.S. Appl. No. 11/519,058 dated Jan. 12, 2009.
Non-Final Office Action for U.S. Appl. No. 11/689,875 dated Feb. 17, 2009.
Non-Final Office Action for U.S. Appl. No. 11/689,614 dated Apr. 15, 2009.
Office Action for U.S. Appl. No. 11/613,692 dated May 14, 2009.
Advisory Action for U.S. Appl. No. 11/519,058 dated Jun. 18, 2009.
Non-Final Office Action for U.S. Appl. No. 11/519,058 dated Sep. 4, 2009.
Non-Final Office Action for U.S. Appl. No. 11/689,614 dated Jan. 12, 2010.
Notice of Allowance for U.S. Appl. No. 11/519,058 dated Mar. 19, 2010.
Non-Final Office Action for U.S. Appl. No. 12/848,884 dated Apr. 6, 2011.
Final Office Action for U.S. Appl. No. 12/848,884 dated Sep. 22, 2011.
Notice of Allowance for U.S. Appl. No. 12/710,079 dated Oct. 14, 2011.
Non-Final Office Action for U.S. Appl. No. 12/710,079 dated May 16, 2011.
Non-Final Office Action for U.S. Appl. No. 12/848,884 dated Apr. 20, 2012.
Final Office Action for U.S. Appl. No. 12/848,884 dated Sep. 14, 2012.
Notice of Allowance for U.S. Appl. No. 12/848,884 dated Nov. 30, 2012.
Restriction Requirement for U.S. Appl. No. 13/371,214 dated Mar. 7, 2013.
Notice of Allowance for U.S. Appl. No. 13/371,214 dated Jul. 19, 2013.

* cited by examiner

LED LIGHTING FIXTURE

RELATED APPLICATIONS

This present application is a continuation of and claims the benefit to the filing date of U.S. patent application Ser. No. 11/689,614, filed Mar. 22, 2007 now U.S. Pat. No. 7,824,074, the disclosure of which is incorporated herein by reference in its entirety.

BACKGROUND

Example embodiments of the present invention in general relate to a light emitting diode (LED) lighting fixture.

DESCRIPTION OF THE RELATED ART

High Intensity Discharge (HID) lighting sources are used for a wide array of lighting applications in public spaces such as stores, libraries, theatres and school gymnasiums, for example. An HID lighting fixture typically utilizes a metal halide bulb. For example, FIG. 1 illustrates the use of HID lighting fixtures 100 in one such space, the setting of a big box department store. Typically these fixtures 100 are attached approximately 16 to 25 feet above the surface of the store floor to provide lighting throughout the store.

The Illuminating Engineering Society of North America (IESNA) is the recognized technical authority on illumination and puts out specifications for various types of illumination. The IESNA provides recommendations based on categories and conditions of a particular application or space for brightness, or illuminance. The measurement for illuminance is typically given in foot candles (fc). A footcandle is a unit of illuminance in the foot-pound-second system of units, and represents the illuminance at 1 foot from a I-candela point source of light. One footcandle is approximately 10.76391 lux (lumens/m"), and in the lighting industry is typically associated as1 fc =10 lux.

As an example, the IESNA designates a category A space as a public space, providing examples such as corridors and an ATM key pad, and recommending an illuminance per fixture of 3 fc. Category B areas are spaces where people remain a short time, such as elevators, refrigeration spaces, stairs, etc; the recommended illuminance for a fixture in these spaces is 5 fc. Category C spaces include working spaces with simple visual tasks i.e., exhibition halls and restrooms. Fixtures in these spaces should have a recommended illuminance of 10 fc.

Category D spaces require a condition for performing visual tasks of high contrast and large size; examples include libraries and museums. The IESNA recommends an illuminance of approximately 30 fc for fixtures in Category D spaces. In spaces requiring a condition for performing visual tasks at high contrast and small size or low contrast and large size (Category E spaces), such as classrooms, food service areas and kitchens, the IESNA recommends a fixture illuminance of approximately 50 fc. A category F space includes school gymnasiums or other areas where visual tasks of low contrast and small size are required. A fixture for a category F space is recommended to have an illuminance of 100 fc. Additionally, there is a category G space, such as an autopsy table or a surgical task, in which the brightness or illuminance is required for visual tasks near a threshold. The IESNA recommends a fixture illuminance of 300 fc for a category G space.

FIG. 2A is a perspective view of a conventional HID lamp fixture employing a metal halide bulb, which is shown in FIG. 2B. Referring to FIGS. 2A and 2B, a conventional HID lamp fixture 100 includes a reflector 110 which is coupled to plug unit 120 that is connected to AC wall plug power, for example. The fixture 100 also includes a ballast 130 which is configured to hold and power metal halide bulb 140.

The HID lamp fixture 100 shown in FIGS. 2A and 2B utilizes a 400 watt metal halide bulb 140 and is configured to receive 436 watts (AC) of wall plug power, to provide a total light output of approximately 15,771 lumens. As noted, HID lamp fixture 100 is a typical lighting fixture used in lighting applications in spaces such as the big box department store shown in FIG. 1, for example.

However, there are several reasons why use of HID lamps are disadvantageous, thus requiring a need for a solid state lighting (SSL) light source to replace the metal halide high bay fixture such as the HID lamp fixture 100 shown in FIGS. 1, 2A and 2B. One concern is the high cost of maintenance. In order to change the metal halide bulb 140 when it goes bad, a lift has to be used along with several people; this adds up to a substantial cost in labor and machinery usage.

Another concern is required warm-up time for the metal halide bulb 140. Typically, it takes approximately 10 minutes for the metal halide bulb 140 to fully warm up to its maximum brightness. Additionally, the metal halide bulb 140 requires a cool down period before the lamp fixture 100 can be turned on again.

A further reason to look to a possible SSL replacement is that for a lighting application as shown in FIG. 1, the metal halide bulb 140 produces a flicker and a slight humming sound when it is energized. The flicker can cause what is known as a stroboscopic effect. The stroboscopic effect makes an object appear to be moving at a rate different than the actual rate at which the object is moving.

Further, metal halide bulbs pose an environmental hazard, in that the bulb materials include mercury. This mercury has to be safely disposed of when the metal halide bulb is no longer usable in fixture 100. Moreover, a typical metal halide bulb's cycle life lasts from about 6,000 to 17,000 hours. However, in order to attain this average life cycle, metal halide manufacturers recommend that the bulb be turned off for about 15 minutes at least once weekly. Accordingly, due to the shortened life and high cost of maintenance, coupled with environmental concerns, the metal halide bulb is not the most efficient and/or cost effective lighting source for many of the categories A-G above, such as the "high bay" lighting application shown in FIG. 1, for example.

LEDs are becoming more widely used in consumer lighting applications. In consumer applications, one or more LED dies (or chips) are mounted within a LED package or on an LED module, which may make up part of a LED lighting fixture which includes one or more power supplies to power the LEDs. Various implementations of LED lighting fixtures are becoming available in the marketplace to fill a wide range of applications. LEDs offer improved light efficiency, a longer lifetime, lower energy consumption and reduced maintenance costs, as compared to HID light sources.

SUMMARY

An example embodiment is directed to a light-emitting diode (LED) lighting fixture configured for a variety of lighting applications. The LED lighting fixture includes a main housing having a bottom surface supporting an array of LEDs, a top surface and sides, and at least one driver provided in a side housing attached to a side of the main housing to drive the LED array. The thickness of the side housing is equal to or greater than the thickness of the main housing. A plurality of heat spreading fins is arranged on the top surface of the main housing.

Another example embodiment is directed to a LED lighting fixture which includes a main housing supporting an array of LEDs, and at least one side housing attached to the main housing and enclosing at least one power supply to drive the LED array. A cross-sectional thickness of the fixture is 4.0 inches or less.

Another example embodiment is directed to a LED lighting fixture which includes a main housing supporting an array of LEDs a main housing supporting an LED array thereon, and at least one side housing attached to a side of the main housing and enclosing a power supply to drive the LED array. The light output per square inch of the LED array is at least 40 lumens/in".

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments.

DETAILED DESCRIPTION OF THE EXAMPLE EMBODIMENTS

Example embodiments illustrating various aspects of the present invention will now be described with reference to the figures. As illustrated in the figures, sizes of structures and/or portions of structures may be exaggerated relative to other structures or portions for illustrative purposes only and thus are provided merely to illustrate general structures in accordance with the example embodiments of the present invention.

Furthermore, various aspects of the example embodiments may be described with reference to a structure or a portion being formed on other structures, portions, or both. For example, a reference to a structure being formed "on" or "above" another structure or portion contemplates that additional structures, portions or both may intervene there between. References to a structure or a portion being formed "on" another structure or portion without an intervening structure or portion may be described herein as being formed "directly on" the structure or portion.

Additionally, relative terms such as "on" or "above" are used to describe one structure's or portion's relationship to another structure or portion as illustrated in the figures. Further, relative terms such as "on" or "above" are intended to encompass different orientations of the device in addition to the orientation depicted in the figures. For example, if a fixture or assembly in the figures is turned over, a structure or portion described as "above" other structures or portions would be oriented "below" the other structures or portions. Likewise, if a fixture or assembly in the figures is rotated along an axis, a structure or portion described as "above" other structures or portions would be oriented "next to", "left of" or "right of" the other structures or portions.

Example embodiments to be described hereafter are directed to a solid state lighting (SSL) replacement fixture for a conventional HID lamp fixture. In one example, the SSL replacement fixture is an LED-based lighting fixture for high brightness/performance applications. The LED lighting fixture can include multiple high brightness LED lamps, a means for heat spreading, and one or more drivers to operate the LEDs.

The LED lamps can be configured for white light or any other desired color, and fixture designed to match or exceed the brightness output and performance of existing conventional light sources such as HID lamp fixtures, while maintaining a similar fixture size.

Figure 3A:
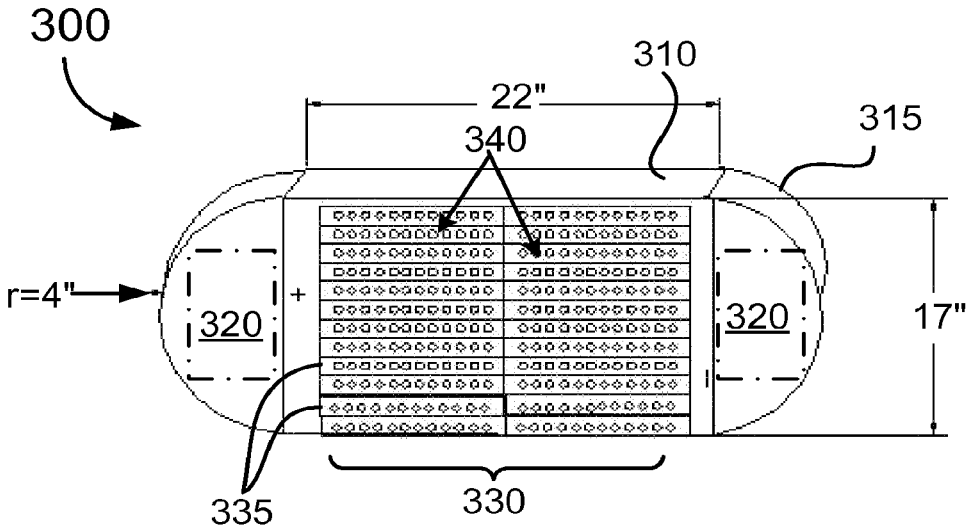
FIG. 3A illustrates a bottom view of an LED lighting fixture in accordance with an example embodiment.
Figure 3B:
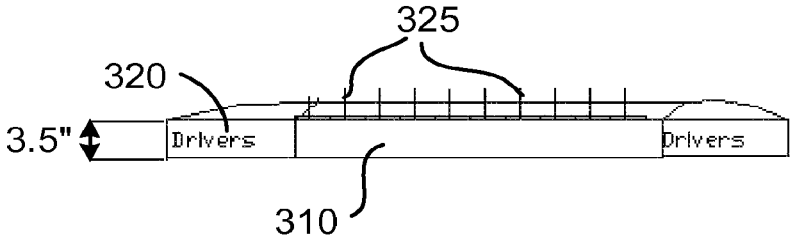
FIG. 3B a perspective front view of the LED lighting fixture in FIG. 3A.

FIG. 3A illustrates a bottom view, and FIG. 3B a perspective front view of an LED lighting fixture in accordance with the example embodiments. Referring to FIGS. 3A and 3D, the LED lighting fixture 300 includes a main housing 310 and two curved side housings 315 attached thereto. Both the main housing 310 and side housings 315 may be made of a material providing a heat sinking or heat spreading capability, such as aluminum, ceramic and/or other materials, and connected to each other through suitable fastening means. In another example, the housings 310/315 can be made as a single integral housing with covers attached on one or both housings 310, 315 to protect electronic components therein from environmental conditions, dirt, debris, etc. In an example, housings 310 and 315 may be ½"thick lightweight aluminum honeycomb panels such as those fabricated by McMASTER-CARR. The side housings 315 in this example have a radius of about 4".

To reduce a thickness profile of the fixture 300, the side housings 315 enclose power supplies 320 (shown in phantom). The power supplies 320 drive a plurality of LED lamps (hereafter LEDs 340) that are attached on a bottom surface of the main housing 310. Each side housing 315 may include a power supply for driving an LED array 330. The power supplies may be constant current drivers 320 which supply constant but adjustable current with variable voltage, depending on the number of LEDs 340. For example, a suitable power supply may be a switch mode, switching LP 1090 series power supply manufactured by MAGTECH, such as the MAGTECH LP 1090-XXYZ-E series switchmode LED driver, for example. The driver 320 has an adjustable voltage range and the type of driver depends on the voltage drop of each of the LEDs 340 in series in the LED array 330.

As shown in FIG. 3A, the LED array 330 is comprised of a plurality of PCB strips 335 which are provided on a backing such as aluminum bars (not shown) or affixed directly to the bottom surface of main housing 310. Each PCB strip 335 can include a line of serially arranged LEDs 340 thereon. In the example shown in FIGS. 3A and 3B, there are 240 LEDs 340 mounted on a plurality of strips 335 affixed within a 22 inch by 17 inch surface area of main housing 310. However, array 330 could be modified to accommodate different numbers of LED strips 335 and/or a different total number of LEDs 340 than shown in FIGS. 3A or 3B, for example. The side housing 315 can have thickness that is equal to or greater than main housing 310. The overall cross-sectional thickness of the fixture 300 is 4" or less. In the example shown in FIG. 3B, the cross-sectional thickness is approximately 3.5 inches. The light output per square inch for the LED array 330 is at least 40 lumens/in$^{2}$.

The strips 335 of LEDs 340 may be secured to the main housing 310 with suitable fasteners such as screws, so as to be easily removable. One, some or all strips 335 may be switched out and replaced with any other strips 335, of any size, so long as it fits within the footprint of the space available for the LED array 330 within the main housing 310.

In an alternative, the strips 335 of LEDs 340 may be secured to a backing plate (not shown) made of a suitable thermally conducted material such as copper, for example. The backing plate can be secured to an interior (bottom) surface of the main housing 310 with suitable fasteners such as screws, so as to be easily removable. The entire LED array 330 may be switched out and replaced with another LED array 330, of any size, so long as it fits within the footprint of the space available within the main housing 310.

Each line of LEDs 340 is electrically connected in parallel to its adjacent column or line via wires (not shown for clarity) and may be equally spaced as measured in the horizontal direction along the bottom surface of housing 310 from the center of adjacent LEDs 340. The LEDs 340 may also be equally spaced in the vertical direction across the bottom surface of housing 310, for example.

The LEDs 340 may be configured to emit any desired color of light. The LEDs may be blue LEDs, green LEDs, red LEDs, different color temperature white LEOs such as warm white or cool or soft white LEDs, and/or varying combinations of one or more of blue, green, red and white LEDs 340. In an example, white light is typically used for area lighting such as street lights. White LEDs may include a blue LED chip phosphor for wavelength conversion.

Individual LEDs 340 of the array 330 can be slanted at different angles, at the same angles, in groups of angles which differ from group to group, etc. For example, in an area lighting application, the shape of the light output may be varied by the angle of the LEDs 340 from the planar bottom surface of main housing 310. Thus, by swapping out differently configured LED arrays 330, the shape or orientation of the array 330 with LEDs 340 thereon can be adjusted to provide an LED lighting fixture 300 which can generate illumination patterns for IESNA-specified Category A-G spaces, and/or to generate IESNA-specified Types I, II, III, IV or V roadway illumination patterns.

Accordingly, for a given LED array 330, one, some, or all strips 335 or subsets of strips 335 having LEDs 340 thereon can be mounted at different angles to the planar, bottom surface of the main housing 310. Additionally, a given strip 335 may be straight or curved, and may be angled with respect to one or more dimensions. In another example, one or more LEDs 340, subsets of strips 335 or entire strips 335 of LEDs 340 constituting the LED array 330 may include the same or different secondary optics and/or reflectors. A secondary optic shapes the light output in a desired shape: thus reflectors for the LEDs 340 can have any pattern such as circle, ellipse, trapezoid or other pattern.

In other examples, individual LEDs 340, subsets of strips 335 and/or strips 335 of LEDs 340 of the LED array 330 may be mounted at varying ranges of angles, and different optical elements or no optical elements may be used with one or more LEDs 340, subsets of strips 335 or entire strips 335 of LEDs 340 that are mounted at differing ranges of angles. The angles of the LED strips 335 and/or LEDs 340 with or without optical elements can be fixed or varied in multiple dimensions. Therefore, one or more strips 335 of LEDs 340 constituting LED array 330 can be set at selected angles (which may be the same or different for given strips 335) to the bottom surface of the main housing 310, so as to produce any of IESNA-specified Type I, Type II, Type III, Type IV and Type V roadway illumination patterns.

Example configurations of angled LEDs 340 or angled strips 335 of an LED array 330 are described in more detail in co-pending and commonly assigned U.S. patent application Ser. No. 11/519,058, to VILLARD et al, filed Sep. 12, 2006 and entitled "LED LIGHTING FIXTURE", the relevant portions describing the various mounting angles of strips 335 and/or LEDs 340 being hereby incorporated in its entirety by reference herein.

Referring to FIG. 3B and looking at a top surface of main housing 310, a plurality of fins 325 (also known as heat spreading T-bars) are provided with channel spacings there between to facilitate thermal dissipation. In one example, these fins 325 can be formed as part of a single cast modular main housing 310. The fins 325 therefore provide a heat spreading function to remove heat generated by the LEDs 340 and drivers 320 within the fixture 300.

Figure 2A:
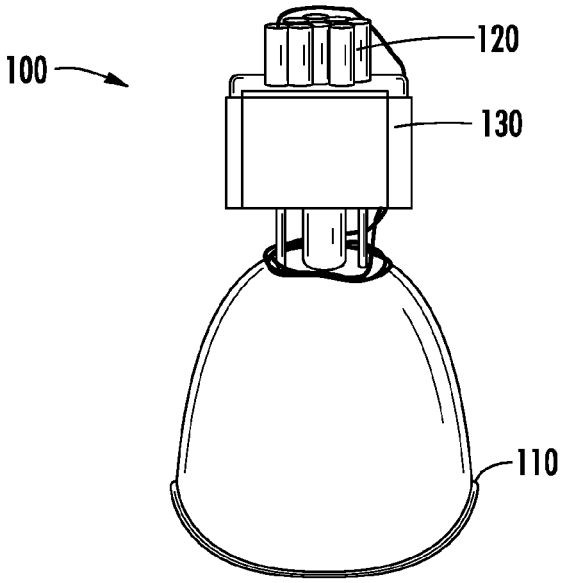
FIG. 2A (PRIOR ART)
FIG. 2A is a perspective view of a conventional HID lamp fixture.
Figure 2B:
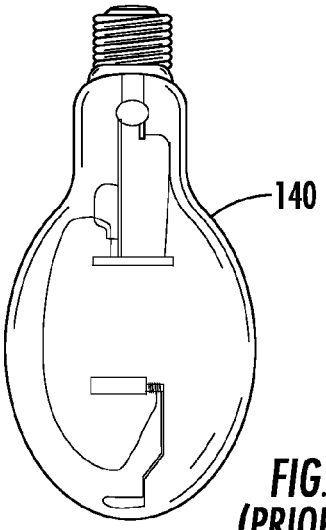
FIG. 2B (PRIOR ART)
FIG. 2B is a front view of a metal halide bulb used in HID lamp fixture of FIGS. 1 and 2A.

For the fixture 300 shown in FIGS. 3A and 3B, the average output of each LED 340 is approximately 83 lumens, to provide a total light output for the fixture 300 of approximately 15,520 lumens. This is consistent with the total light output of the HID lamp fixture 100 with 400W metal halide bulb 140 shown in FIGS. 2A and 2B.

Figure 4A:
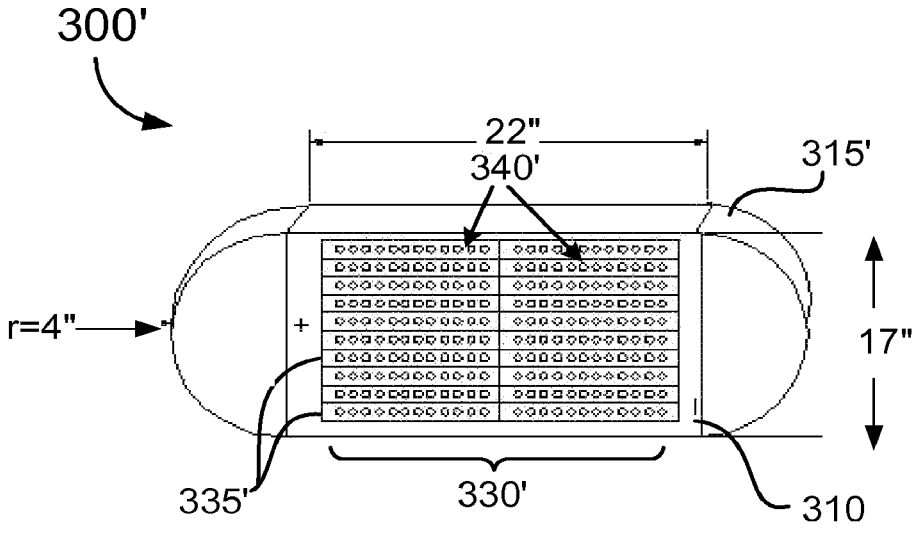
FIG. 4A illustrates a bottom view of an LED lighting fixture in accordance with another example embodiment.
Figure 4B:
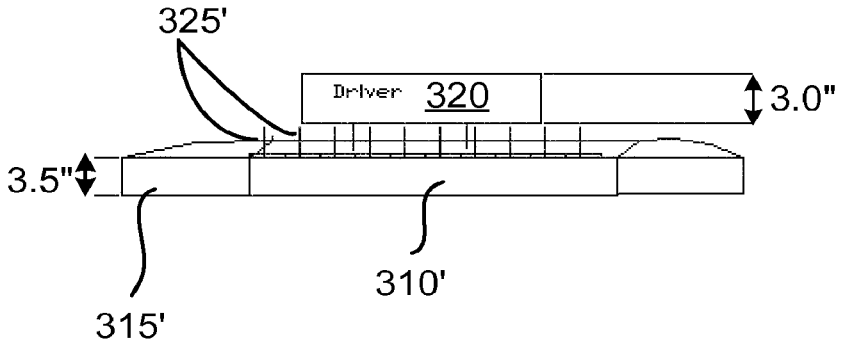
FIG. 4B a perspective front view of the LED lighting fixture in FIG. 4A.

FIGS. 4A and 4B illustrate an LED fixture 300' in accordance with another example embodiment. Fixture 300' is similar to that shown in FIGS. 3A and 3B, with the exception that a driver 320' is attached on a top surface of the fixture 300' with the heat spreading fins 325' between the main housing 310' and the driver 320' such that the driver 320' resides on top of the heat spreading fins 325'. As in FIGS. 3A and 3B, a semicircular side housing 315' is attached to either side of the main housing 310'. In this example, the LED array 330' includes a plurality of PCB strips 335', each strip 335' having a serial line of LED lamps 340' thereon.

Fixture 300' illustrates 200 LEDs evenly spaced across a widthwise distance of 17 inches. Thus, 200 LEDs 340' are mounted on PCB strips 335' attached to the bottom surface within a 22 inch×17 inch surface area on the main housing 310'. In the example shown in FIG. 3B, the cross-sectional thickness of the side housing 315' and main housing is approximately 3.5 inches. The cross-sectional thickness of the driver 320' can add about 3 inches.

Figure 1:
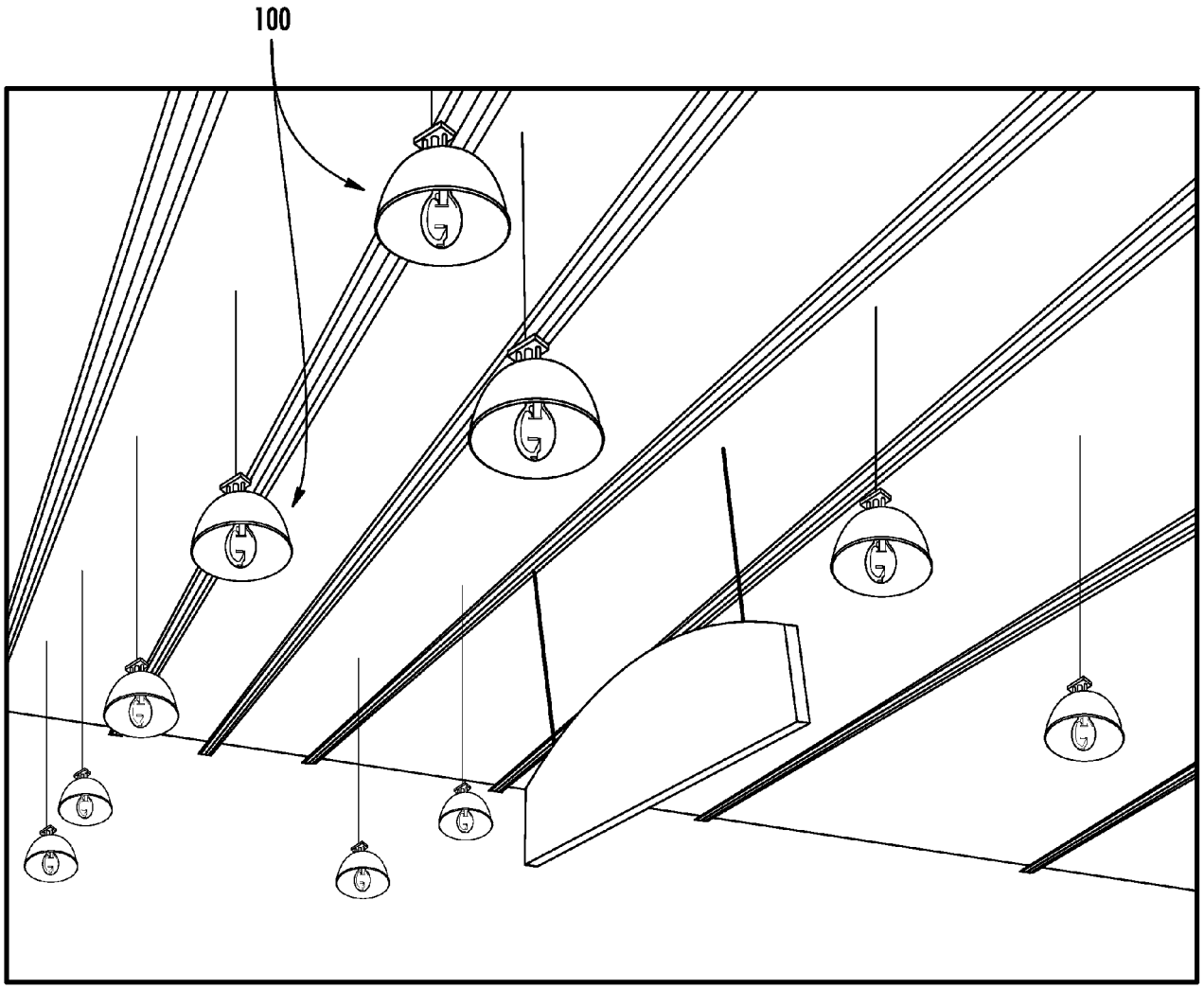
FIG. 1 (PRIOR ART)
FIG. 1 illustrates a standard HID lighting fixture 100 in the context of a conventional lighting application.

As in FIGS. 3A and 3B, the average output of each LED is 83 lumens, to provide a total light output for the fixture 300' at approximately 13,370 lumens. Attaching the drivers 320' on the top surface of the LED fixture 300' increases the total thickness. Further, configured the LED array 330' with 200 LEDs each having an average output of 100 lumens per LED 340' would provide a total light output from fixture 300' in excess of 15,000 lumens, consistent with the conventional HID lamp fixture 100 shown in FIGS. 1 and 2. The light output per square inch for LED array 330' is at least 40 lumens/in.$^{2}$, as in the previous example embodiment.

Figure 5A:
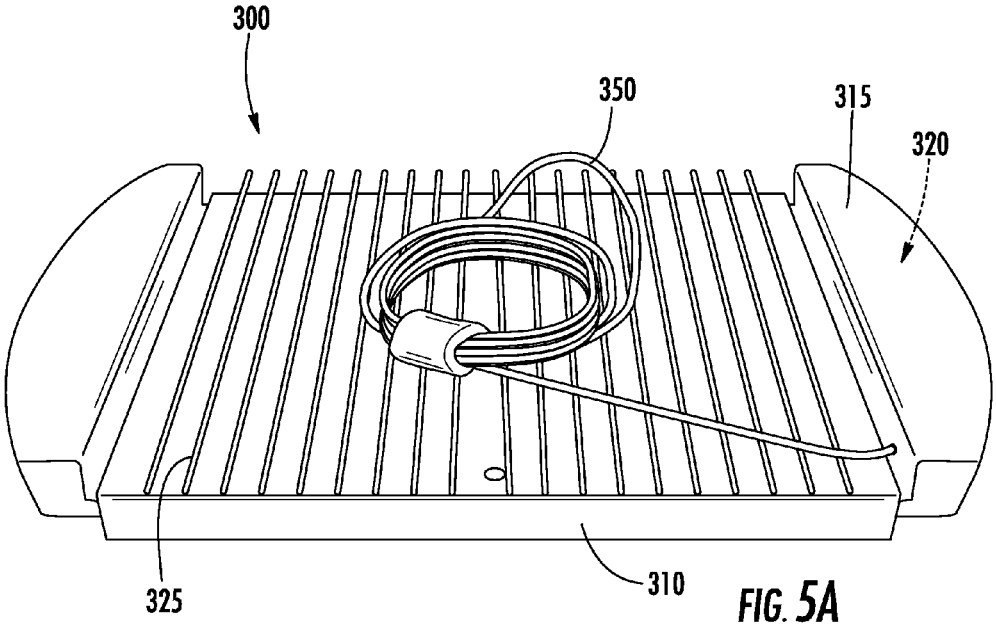
FIG. 5A is a perspective view of a top side of a prototype LED lighting fixture 300.
Figure 5B:
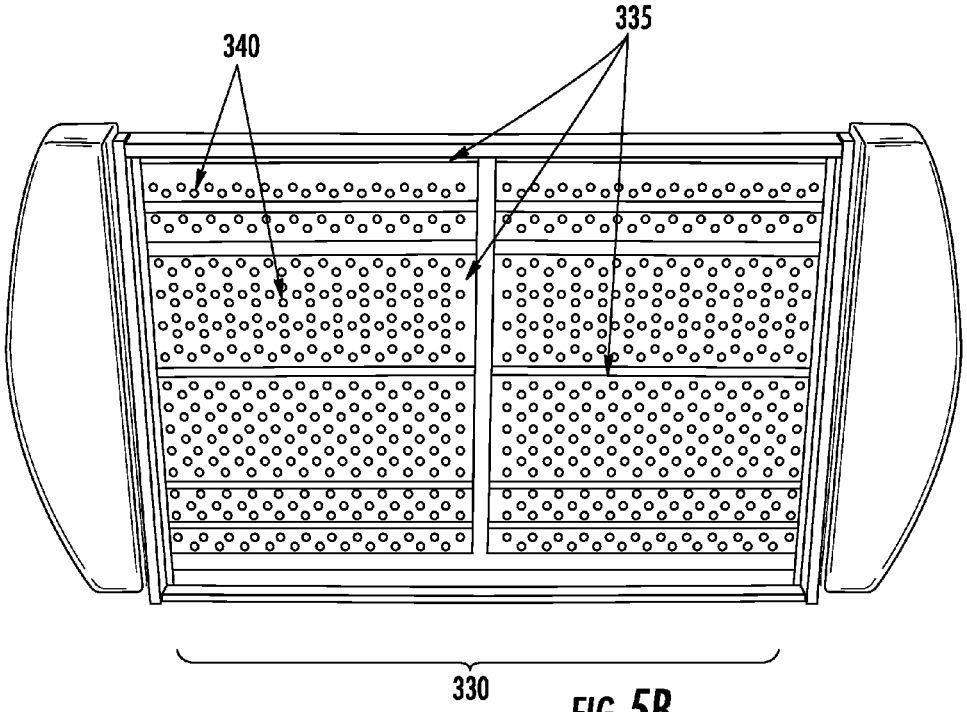
FIG. 5B is a perspective view of a bottom side of the prototype LED lighting fixture of FIG. 5B.

FIGS. 5A and 5B are photographs of a prototype LED lighting fixture 300 built and tested by the inventors; this fixture corresponds to the LED lighting fixture 300 shown in FIGS. 3A and 3B. The LED fixture 300 includes main housing 310 which houses a plurality of PCB strips 335, each of which are a differing size and include a plurality of LEDs 340 thereon. The sets of strips 335 comprise the LED array 330 on the bottom surface of main housing 310. The side housings 315 which house the drivers 320 therein are clearly shown in FIGS. 4A an 4B. A power cord 350 is attached to one of the drivers to provide AC line power to the fixture 300.

Although the drivers 320 in FIGS. 3A and 4A are shown either at the side of main housing 310 or on a top surface of main housing 310, the drivers 320 can be positioned adjacent to the LED array 330 within main housing 310, on opposite front and rear side ends of main housing, and/or around the periphery of the LED array 330, main housing 310 or portions thereof.

COMPARATIVE EXAMPLE

The LED fixture 300 shown in FIGS. 5A and 5B was tested against the HID lamp fixture 100 shown in FIG. 2. The test was performed by Luminaire Testing Laboratory, Inc. of Allentown, PA using a Graseby 211 Calibrated Photometer system. Both fixtures 100, 300 were tested at an elevation of 16 feet above the floor surface. The HID lamp fixture 100 was outfit with a 400W metal halide bulb and was powered by 436 watts (AC) of wall plug power. The LED fixture 300 included 240 Cree XLamp® XR-E LEDs, with an average lumen count of 80 lumens per LED at 350 mA of constant current. The LED array covered a 22" x 17" area, as previously described, for a light output of 41.5 lumens/in$^2$. The wall plug power to the LED fixture 300 was 286.8 watts, approximately 150 watts less than the wall plug power supplied to the HID lamp fixture 100. The dimensions of the fixture 300 are as shown in FIGS. 3A and 3B. The dimensions of HID lamp fixture 100 include a reflector having a 16 inch diameter and a height of 21 inches. Table 1 below illustrates the data taken in this test for both fixtures 100 and 300.

TABLE 1

Comparative Data (Standard HID Lamp Fixture vs. LED Fixture)

| | Standard HID Fixture | LED Fixture |
|---|---|---|
| Usable Lumens | 15571 | 15524 |
| Nadar (fc) | 23.5 fc | 32.6 fc |
| 50% (ft) | 25.1 ft | 17.9 ft |
| Power | 436 W | 286.8 W |

Referring to Table 1, the standard HID lamp fixture 100 had a total light output of 15,771 lumens. The LED fixture 300, which can be characterized as an SSL replacement for the HID lamp fixture 100, had a total light output of 15,524 lumens.

The Nadar measurement, which is a measure of illumination or brilliance in footcandles directly underneath the fixture, showed a marked improvement for the LED fixture 300. The standard HID lamp fixture 100 had a Nadar measurement of 23.5 fc, whereas the LED fixture 300 had a Nadar illumination of 32.6 fc directly underneath the fixture. As noted, this was measured at a vertical distance of 16 feet from the fixture to the floor surface.

The next row in Table 1 illustrates a 50% power point for each fixture. The half power point is measured in linear feet from the fixture at which the fixture is at 50% power in terms of illumination. The half power point for the standard HID lamp fixture 100 was 25.1 feet (11 fc s), whereas the half power point for the LED fixture 300 was 17.9 feet or 16 fcs of illumination.

As previously noted, the power required by the standard HID lamp fixture 100 was 436 watts from the wall plug, but only required 286.8 watts for powering the LED fixture 300. Although the LED fixture 300 tested in this comparison utilized 240 LED lamps 340, the fixture could be configured with 200 LED lamps, each having an average output of 100 lumens to obtain the same or near same results.

Accordingly, the example LED lighting fixtures 300/300' described herein may be well suited to replace conventional HID lighting source s. LED light sources have longer life, are more energy efficient and can provide a full range of light colors (CRI) as compared to conventional HID lighting sources. CRI, or color rendering, is the ability of a light source to produce color in objects. The CRI is expressed on a scale from 0-100, where 100 is the best in producing vibrant color in objects. Relatively speaking, a source with a CRI of 80 will produce more vibrant color in the same object than a source with a CRI of 60. As shown above, the tested LED fixture 300 meets or exceeds the brightness output and performance of an existing HID lamp fixture 100 without requiring a larger fixture size.

Additionally, by changing the average lumen output of the LEDs 340, the number of LEDs per squared inch or foot can be adjusted to mirror the lighting performance of the HID lamp fixture 100 at a reduced cost. Further, and unlike the conventional HID lighting sources, the use of LEDs provide an ability to adjust the CRI by mixing different LED lamp colors, Le., different combinations of white LED lamps and/or color LED lamps for a given CRI.

Further, the location of the drivers 320 in the example embodiment of FIGS. 3A, 3B and SA and 5B reduce the profile and thickness of the LED lighting fixture 300. Further, the use of heat spreading fins 325 on a surface thereof limits the effect of the heat generated by the LEDs 340 and/or drivers 320 from affecting the performance or output of the LED lighting fixture 300.

As previously noted, a conventional HID lighting source such as a metal halide high bay fixture has a high cost in terms of maintenance (multiple people to change out the bulb). This limits the cycle life of a typical metal halide bulb from about 6,000 to 17,000 hours of illumination use, and requires a weekly turnoff for about 15 minutes in order to obtain a cycle life within this average range. LEDs on the other hand never have to be turned off and in the embodiments shown herein are rated to last approximately 50,000 hours, about six times as long as the metal halide bulb. Additionally, almost no warm-up time is required for an LED, as turn on is essentially instantaneous. Further, no flicker or slight humming sound is produced by an LED lamp which would cause a stroboscopic effect, as is inherent in the metal halide bulb.

The use of LED lamps for high brightness/performance applications is also desirable from an environmental standpoint, as LEDs contain no mercury and do not require the special disposal requirements as is necessitated for metal halide bulbs which contain mercury. Moreover, as the rated cycle life of an LED lamp is approximately 50,000 hours, and as the LED lighting fixture 300 requires much less wall plug power than the corresponding metal halide bulb, an SSL replacement fixture for an HID lamp fixture, such as the LED lamp fixture 300 shown herein above, is more energy efficient.

The example embodiments being thus described, it will be obvious that the same may be varied in many ways. Such variations are not to be regarded as departure from the spirit and scope of the example embodiments of the present invention, and all such modifications as would be obvious to one skilled in the art are intended to be included within the scope of the following claims.

The invention claimed is:

1. A light-emitting diode (LED) lighting fixture, comprising:

a main housing comprising a top surface supporting one or more heat spreading members and an opposing bottom surface supporting an array of LEDs, the main housing extending along a first direction; and at least one side housing attached to the main housing and extending from the main housing in the first direction, wherein cross-sectional thicknesses of the main housing and the side housing are substantially the same;

at least one constant current driver disposed in the at least one side housing, wherein the constant current driver is configured to deliver at least approximately 350 milliamps (mA) of constant current to each LED in the array of LEDs;

wherein the array of LEDs is configured to output light from the bottom surface in a direction that is different than the first direction, and wherein the combined light output from the array of LEDs is at least 15,000 lumens for high brightness applications.

2. The fixture of claim 1, wherein the at least one constant current driver comprises a power supply within the side housing.

3. The fixture of claim 1, wherein the light output per square inch of the LED array is at least 40 lumens/in.$^2$.

4. The fixture of claim 1, wherein the side housing is curved along one side thereof.

5. The fixture of claim 1, wherein the heat spreading members comprise a plurality of heat spreading fins arranged on a top surface of the main housing.

6. The fixture of claim 1, wherein the LED array comprises a plurality of printed circuit board (PCB) strips attached to the bottom surface of the main housing, each PCB strip including a plurality of serially-connected LEDs thereon.

7. The fixture of claim 6, wherein one or more LEDs or one or more strips of LEDs in the array are fitted with a secondary optic.

8. The fixture of claim 6, wherein one or more LEDs or one or more strips of LEDs in the array are mounted at an angle to the bottom surface of the main housing.

9. The fixture of claim 6, wherein one or more LEDs in the array or one or more strips of LEDs are configured to output different colored light.

10. A light-emitting diode (LED) lighting fixture, comprising:

a main housing having a plurality of sides disposed about a planar outer surface configured for supporting an LED array thereon, and a plurality of side housings attached to the main housing, each side housing attached to a different side of the main housing so that the side housings are adjacent the main housing;

at least one constant current driver disposed in at least one of the plurality of side housings, wherein the constant current driver is configured to deliver at least approximately 350 milliamps (mA) of constant current to each LED in the array of LEDs, and wherein the light output per square inch of the LED array from the outer surface of the main housing is at least approximately 40 lumens/in$^2$.

11. The fixture of claim 10, wherein the thickness of each of the side housings is equal to or greater than the thickness of the main housing.

12. The fixture of claim 10, wherein a cross-sectional thickness of the fixture is 4.0 inches or less.

13. The fixture of claim 10, wherein the combined light output from the array of LEDs is at least 15,000 lumens.

14. The fixture of claim 10, further comprising: a plurality of heat spreading fins arranged on a top surface of the main housing.

15. The fixture of claim 10 , wherein the LED array comprises a plurality of printed circuit board (PCB) strips attached to a the planar outer surface comprising a bottom surface of the main housing, each PCB strip including a plurality of serially-connected LEDs thereon.

16. The fixture of claim 15, wherein one or more LEDs or one or more strips of LEDs in the array are fitted with a secondary optic.

17. The fixture of claim 15, wherein one or more LEDs or one or more strips of LEDs in the array are mounted at an angle to the bottom surface of the main housing.

18. The fixture of claim 15, wherein one or more LEDs in the array or one or more strips of LEDs are configured to output different colored light.

19. The fixture of claim 15, wherein one or more strips of LEDs are removable from the main housing.

20. The fixture of claim 6, wherein one or more strips of LEDs are removable from the main housing.

21. The fixture of claim 6, wherein the plurality of strips of LEDs are mounted at different angles to the bottom surface of the main housing to shape light output of the fixture.

22. The fixture of claim 1, wherein a cross-sectional thickness of the fixture is 4.0 inches or less.

23. The fixture of claim 10, wherein each of the side housings encloses a power supply to drive the LED array.

24. The fixture of claim 15, wherein the plurality of strips of LEDs are mounted at different angles to the bottom surface of the main housing to shape light output of the fixture.

25. A light-emitting diode (LED) lighting fixture, comprising:

a main housing having a bottom surface;

an LED array comprising a plurality of printed circuit board (PCB) strips having LEDs thereon mounted to the bottom surface of the main housing at different angles; and first and second side housings attached to the main housing, at least one of the first and second side housings enclosing a constant current driver configured to deliver at least approximately 350 milliamps (mA) of constant current to each LED in the array of LEDs to drive the LED array so that the combined light output from the array of LEDs is at least 15,000 lumens of white light for high brightness applications;

wherein the LED array is configured to emit light directly outside of the main housing from the bottom surface.

* * * * *